United States Patent [19]

Kazumoto et al.

[11] Patent Number: 4,969,807

[45] Date of Patent: Nov. 13, 1990

[54] GAS COMPRESSOR WITH BUFFER SPACES

[75] Inventors: Yoshio Kazumoto; Kazuo Kashiwamura; Yoshiro Furuishi, all of Hyogo, Japan

[73] Assignee: Mitsubishi Denki Kabushiki Kaisha, Tokyo, Japan

[21] Appl. No.: 387,040

[22] Filed: Jul. 31, 1989

[30] Foreign Application Priority Data

Oct. 31, 1988 [JP] Japan ..... 63-276805

[51] Int. Cl.[5] ..... F02B 17/04; F02B 37/08

[52] U.S. Cl. ..... 417/417; 62/6; 92/162 R; 91/399

[58] Field of Search ..... 417/379, 340, 380, 417; 62/6; 92/134, 162 R; 91/399, 23

[56] References Cited

U.S. PATENT DOCUMENTS 3,991,585 11/1976 Mulder ..... 62/6

4,613,285 9/1986 Sato et al. ..... 92/134

4,911,618 3/1990 Suganami et al. ..... 417/439

*Primary Examiner*—Michael Koczo

*Assistant Examiner*—David W. Scheuermann

*Attorney, Agent, or Firm*—Sughrue, Mion, Zinn, Macpeak and Seas

[57] ABSTRACT

A gas compressor for use in a gas refrigerator includes a compression space having a volume varied with a positional shift of a piston when the latter reciprocates in a cylinder, a first buffer space communicating with the compression space in one direction with respect to the compression space and a second buffer space communicating with the compression space in the opposite direction. Forces acting on working surfaces of the piston are set in such a way that, when a reciprocation stroke of the piston is to be lengthened, a shift of a neutral position of the piston reciprocation toward the compression space is prevented and, when the reciprocation stroke is to be shortened, a shift of the neutral position away from the compression space is prevented, so that the dead space in the compression space is minimized and a highly efficient operation can be realized in a wide output control range.

5 Claims, 8 Drawing Sheets

GAS COMPRESSOR WITH BUFFER SPACES

BACKGROUND OF THE INVENTION

The present invention relates to a gas compressor and, particularly, to a gas compressor to be used in a Stirling cycle machine which is a thermodynamic cycle machine by which high temperature and low temperature or power is generated externally through repeating Stirling cycle of a working gas filled therein.

An example of application of a conventional gas compressor to a Stirling cycle gas refrigerator will be described.

FIG. 8 is a cross sectional side view of a conventional Stirling cycle gas refrigerator similar to that disclosed in, for example, Japanese Patent Publication No. 28980/1979 or U.S. Pat. No. 3,991,585. In this figure, a compressor portion 31 comprises mainly a cylinder 1 and a piston 2 adapted to reciprocate in the cylinder 1. A cold finger 3 encloses a displacer 4 which is reciprocated by pressure variation of working gas and has a lower portion communicated through a communication tube 5 with the cylinder 1.

In the cold finger, a first compression space 7 is formed between a lower working surface 4*a* of the displacer 3 and a communication tube 5 and, in the compressor portion, a second compression space 8 is formed between an upper working surface 2*a* of the piston 2 and the communication tube 5. An expansion space 6 is provided above an upper working surface 4*b* of the displacer 3. The working surface 4*b* forms a border of the expansion space 6 which forms, together with the first compression space 7, the second compression space 8 and spaces within a regenerator 9 and the communication tube 5, etc., a working space. The regenerator 9 can be communicated through a center hole 10 of the displacer 3 with lower working gas and through a center hole 11 and a radial flow duct 12 of the displacer 3 with upper working gas. Further, in this refrigerator, a freezer 13 is provided as a heat exchanger for exchanging heat between expanded cold working gas and members to be cooled thereby.

A clearance seal 14 is arranged between the piston 2 and a wall of the cylinder 1 to prevent working gas from flowing between a first buffer space 15 provided on the side of a lower working surface 2*b* of the piston 2 and the working space. A clearance seal 16 is further provided between the displacer 4 and the cold finger 3 to force working gas between the expansion space 6 and the first compression space 7 to flow through the regenerator 9.

The piston 2 is equipped, on a lower end portion thereof in the first buffer space 15, with a light weight sleeve 17 of non-magnetic material such as aluminum. A coil 18 is wound on the sleeve 17. Opposite ends of the coil 18 are connected through lead wires 19 and 20 passing through the wall of the cylinder 1 to electric terminals 21 and 22 outside the cylinder 1, respectively. The coil 18 can reciprocate in an axial direction of the piston 2 within an annular gap 23 in which an armature magnetic field exists. Magnetic line of force of this armature magnetic field generated by an annular permanent magnet 24 extends radially of a moving direction of the coil 18 from an annular armature 25, through a cylinder 26 to an armature disc 27, which constitute a closed magnetic circuit. The sleeve 17, the coil 18, the lead wires 19 and 20, the annular gap 23, the annular permanent magnet 24, the annular armature 25, the cylinder 26 and the armature disc 27 constitute a linear motor 28 for driving the piston.

Further, the piston 2 and the displacer 4 are resiliently supported in the cylinder 1 and the cold finger 3 through a spring member 29 and a spring member 30, respectively, to fix positions of the piston 2 and the displacer 4 in stationary states thereof and neutral positions during operation.

As mentioned, the cylinder 1, the piston 2, the linear motor 28 and the spring member 29 constitute the gas compressor 31 for producing a pressure variation in the second compression space necessary to generate a cold state and a hot state.

In operation, when an a.c. power source (not shown) having a frequency equal to a resonance frequency of the system is connected across the electric terminals 21 and 22, an a.c. current flows through the coil 18 and the latter is subjected to an axial periodic Lorentz force due to an interaction of the a.c. current and a radial magnetic field produced by the annular permanent magnet 24. As a result, a system composed of the piston 2, the sleeve 17, the coil 18 and the spring member 29 is brought into resonance state and vibrates axially. Vibration of the piston 2 causes a periodic variation of pressure in working gas filled in the working space composed of the expansion space 6, the first compression space 7, the second compression space 8, the communication tube 5, the regenerator 9, the center hole 10, the center hole 11, the radial flow duct 12 and the freezer 13 and causes an axial, periodic and alternative vibration force to be produced in the displacer 4 due to flow rate variation of gas passing through the regenerator 9. In this manner, the displacer 4 including the regenerator 9 reciprocates axially in the cold finger 3 at the same frequency as and with a different phase from that of the piston 2.

When the piston 2 and the displacer 4 operate with a suitable phase difference therebetween, the working gas filling the working space performs a thermodynamic cycle known as "Reverse Stirling Cycle" and generates hot and cold states in the compression space 7 and 8 and the expansion space 6 and the freezer 13, respectively. The "Reverse Stirling Cycle" and the principle of hot and cold state generation are disclosed in detail in "Cryocoolers", G. Walker, Plenum Press, New York, 1983, pp, 177–123. The principle will be described in brief below.

After compression heat of gas in the second compression space 8 generated by compression operation of the piston 2 is dissipated during its passage through the communication tube 5, the working gas flows into the first compression space 7 and passes through the center hole 10 and the regenerator 9 where it is preliminarily cooled in the regenerator 9 by cold state established during a half cycle before. Then the working gas enters through the center hole 11, the radial flow duct 12 and the freezer 13 into the expansion space 6. Once almost all working gas enters into the expansion space 6, expansion commences, resulting in cold state in the expansion space 6. The working gas, then, returns in the reverse direction, while discharging the cold state to the regenerator 9, to the second compression space 8. In this time, the working gas absorbs external heat in the freezer 13 to cool an associated external matter. Then, when almost all working gas returns to the second compression space 8, the compression is restarted to execute a next cycle. The "Reverse Stirling Cycle" is completed according to the process mentioned above to produce cold and hot states.

As will be clear from the foregoings, in the conventional cooler constituted in this way, a cooling performance is generally controlled by changing current to be supplied to the coil 18. That is, the performance is controlled by changing an amplitude of pressure variation within the working space by increasing and decreasing the stroke of the piston 2 by means of a current flowing through the coil 18.

Since the conventional compressor is constituted as mentioned above, in which the neutral point of the piston reciprocation is fixed by the neutral point of the piston spring member, there may be a case where the piston collides with the cylinder when the stroke is varied substantially for the capability control.

Alternatively, in a case where a clearance corresponding to the maximum stroke is given to enlarge the control range, a dead space, i.e., a portion of the compression space in which the piston does not reciprocate, is increased and, therefore, the compression ratio is reduced, resulting in lowered pressure variation per stroke. Therefore, there is a problem that the efficiency of the refrigerator is lowered.

SUMMARY OF THE INVENTION

An object of the present invention is to provide a gas compressor which is capable of operating highly efficiently in a wide output control range.

A gas compressor according to the present invention comprises a compression space provided in a cylinder and having a volume varied with a positional shift of a first working surface provided on a piston when the latter reciprocates, pressure of working gas filled in the space being varied accordingly, two buffer spaces communicated with the compression space through gap sealing portions between the piston and the cylinder and having volumes varied with positional shifts of a second and a third working surfaces provided on the piston and acting in a reverse direction to that of the first working surface and two connecting circuits for connecting the buffer spaces and the compression space through check valves connected such that flow directions looked from the compression space are opposite, wherein forces acting on the piston working surfaces of the buffer spaces are set in such a way that, when a reciprocation stroke of the piston is to be lengthened, a neutral position of the piston reciprocation does not approaches on the side of the compression space and, when the reciprocation stroke is to be shortened, the neutral position does not go away.

In the present invention, when the stroke of the piston is changed during reciprocation thereof, the neutral position of the reciprocation is moved.

DETAILED DESCRIPTION OF THE PREFERRED EMBODIMENTS

Figure 1:
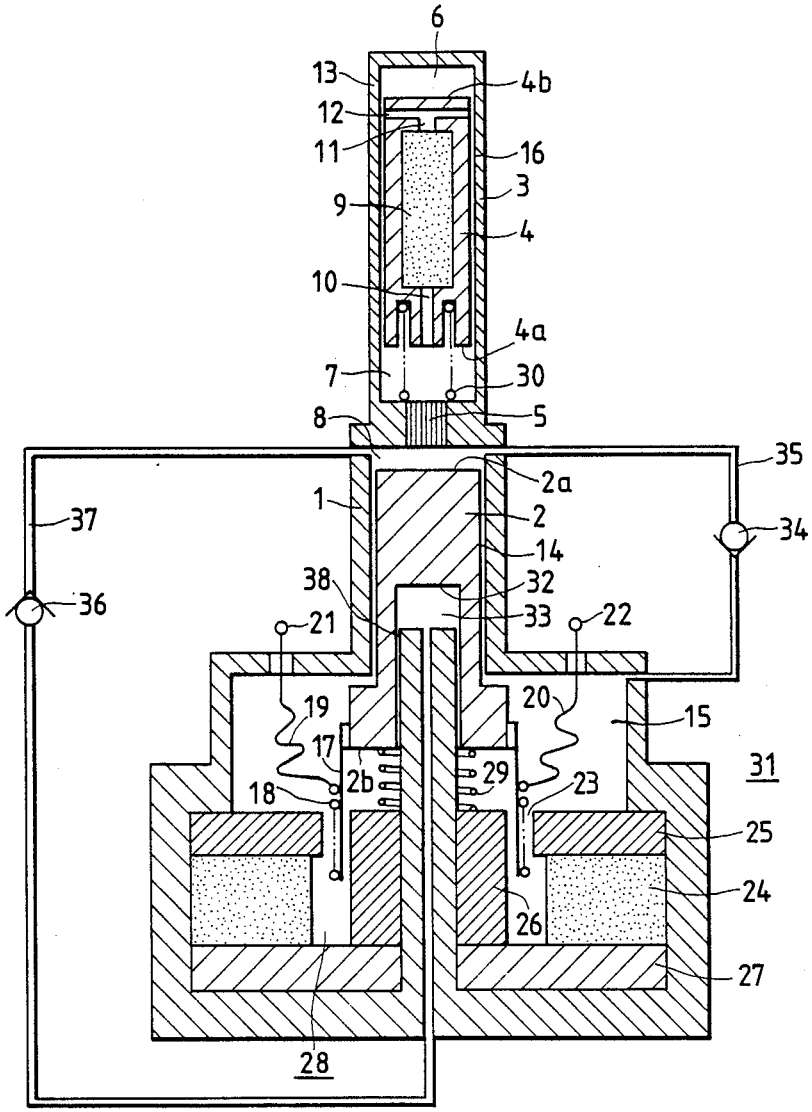
FIG. 1 is a cross sectional side view of a gas refrigerator having a gas compressor according to an embodiment of the present invention.
Figure 8:
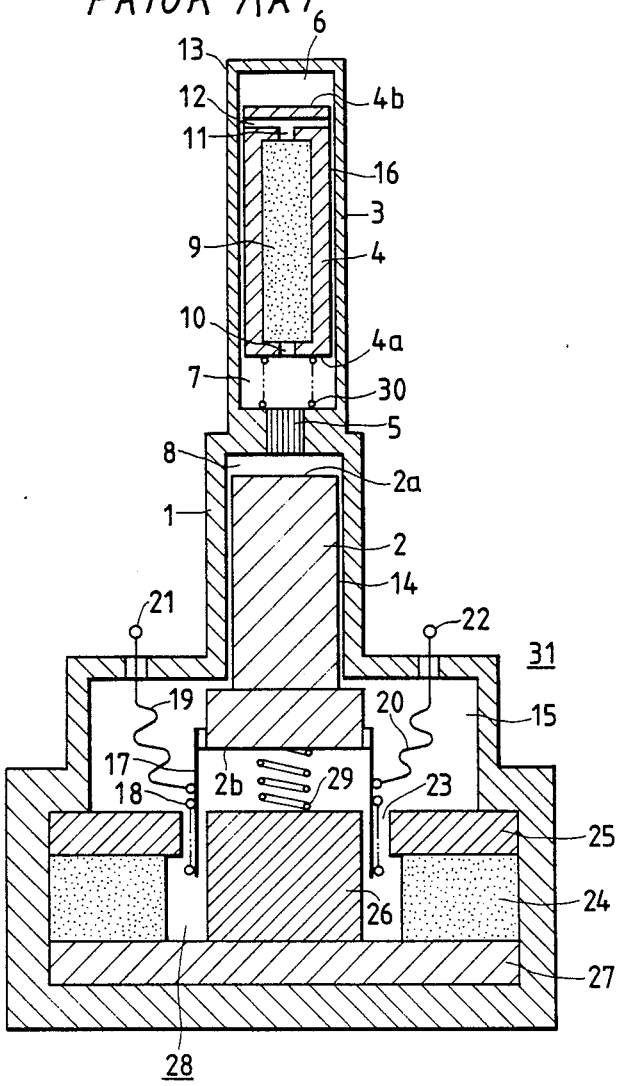
FIG. 8 PRIOR ART
FIG. 8 is a cross sectional side view of an example of a conventional gas refrigerator.

FIG. 1 is a cross sectional side view of a gas refrigerator having a gas compressor according to an embodiment of the present invention, in which same or corresponding portions to those in FIG. 8 showing the prior art are depicted by same reference numerals and detailed descriptions thereof are omitted.

In FIG. 1, the gas refrigerator comprises the gas compressor portion 31 and a cold finger portion 3 integrally mounted on the gas compressor portion. A piston 2 is adapted to reciprocate in a cylinder 1 of the compressor portion 31, defining a second compression space 8 between a top of the cylinder 1 and an upper surface 2*a* of the piston 2 which is referred to as a first working surface. The piston 2 also has a lower end surface 2*b* which acts as a second working surface, and a bottom surface 32 which is a third working surface. The second working surface of the piston 2 is put in a first buffer space 15 and the third working surface is arranged in a blind hole formed in a lower portion of the piston 2.

An upright stud protruding from a bottom of a casing of the gas compressor portion 31 is inserted into the blind hole of the piston 2 with a peripheral clearance seal 38. A second buffer space 33 is defined by the top of the blind hole and an upper surface of the stud such that a volume of the second buffer space 33 is changed by a reciprocation of the piston 2.

The second compression space 8 and the first buffer space 15 are connected by a first connecting circuit 35 having a first check valve 34 in such a way that working gas is permitted to flow from the first buffer space 15 to the second compression space 8. The second compression space 8 and the second buffer space 33 are connected by a second connecting circuit 37 having a second check valve 36 in such a way that working gas is permitted to flow from the second compression space 8 to the second buffer space 33.

The clearance seal 38 provided between the inner wall of the cylinder 1 and the piston 2 serves to maintain working gas in the first buffer space 15 and the second buffer space 33 at respective different average pressures.

An operation of this embodiment will be described below. As described with respect to the conventional example, when the piston 2 and the displacer 4 move with a suitable phase difference therebetween, working gas filling the working space works the "Reverse Stirling Cycle" briefly described in the prior art description and produces cold state in mainly the expansion space 6 and the freezer 13.

Figure 2:
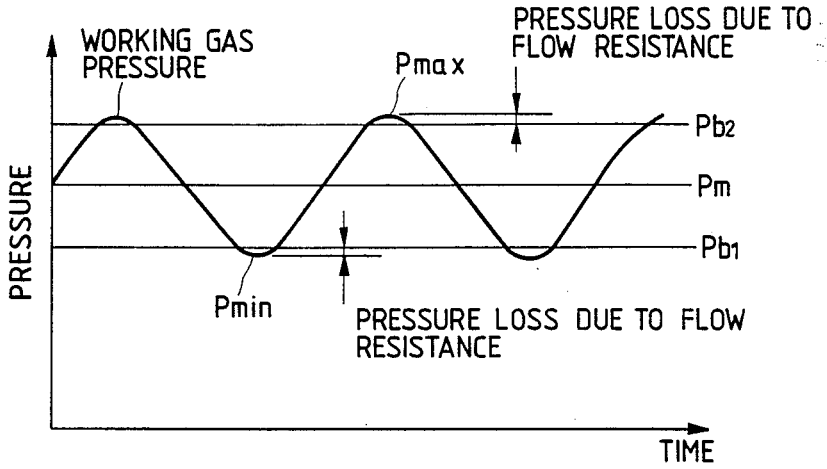
FIG. 2 is an explanatory illustration of an operation of the gas refrigerator shown in FIG. 1.

In the cycle mentioned above, the refrigerator according to the present embodiment differs from the conventional example in the following points. That is, in the present embodiment, the first working surface 2*a*, the second working surface 2*b* and the third working surface 32 are formed on the piston 2 so that the volumes of the second compression space 8, the first buffer space 15 and the second buffer space 33 are changed by reciprocation of the piston 2. Further, since the second compression space 8 and the first buffer space 15 are communicated through the first connecting circuit 35 having the first check valve 34 and the second compression space 8 and the second buffer space 33 are communicated through the second connecting circuit 37 having the second check valve 36, working gas pressures in the second compression space 8, the first buffer space 15 and the second buffer space 33 are changed as shown in FIG. 2 during the operation. In this figure, it is assumed that the volumes of the first buffer space 15 and the second buffer space 33 are sufficiently larger than a swept volume of the piston and pressures therein are substantially constants during the operation.

Depicting areas of the first working surface 2*a*, the second working surface 2*b* and the third working surface 32 by S1, S2 and S3, respectively, and average pressures of working gas in the second compression space 8, the first buffer space 15 and the second buffer space 33 by Pm, Pb1 and Pb2, respectively, a force F (downward being positive) acting on the piston 2 in average becomes $$F=S1*Pm-S2*Pb1-S3*Pb2 \quad (1)$$

Considering an ideal check valve, the followings are established $$Pb1=Pmin \quad (2)$$

$$Pb2=Pmax \quad (3)$$

Further, since $$S1=S2+S3 \quad (4)$$

the following force F acts on the piston 2 during the operation $$F=(\tfrac{1}{2})*(S2-S3)*(Pmax-Pmin) \quad (5)$$

Therefore, the neutral point of reciprocation of the piston 2 is lowered by $$\Delta X=(F/K)=(1/(2*K))*(S2-S3)*(Pmax-Pmin) \quad (6)$$

where K is spring constant of the piston spring member 29.

On the other hand, since the amplitude of pressure variation is substantially proportional to the stroke (S) and can be expressed by $$Pmax-Pmin=C*S \quad (7)$$

C: proportion constant the amount of movement ΔX of the neutral point is substantially proportional to the stroke as is clear from the equations (6) and (7). Thus, by suitably setting the forces acting on the working surface of the piston in the two buffer spaces by changing values of S2, S3 and K and pressure value in the buffer spaces by means of flow resistances in the connecting circuits, the movement ΔX makes it possible to compensate for the movement of the neutral point due to increase or decrease of the stroke of the piston and, therefore, there is no collision of the piston with the cylinder and it is possible to reduce the dead space over a wide performance range. That is, with the movement ΔX of the neutral point being positive, the position of the neutral point (neutral position) does not approach on the side of the second compression space 8 when the stroke increases and does not go away when the stroke decreases, resulting in minimum dead space. For example, in the construction shown in FIG. 1, ΔX becomes positive when the working surface areas of the first and the second buffer spaces satisfy a relation S2≧S3. When the check valves 34 and 36 are connected in reverse directions, respectively, the relation between the working surface areas is also reversed.

Figure 3:
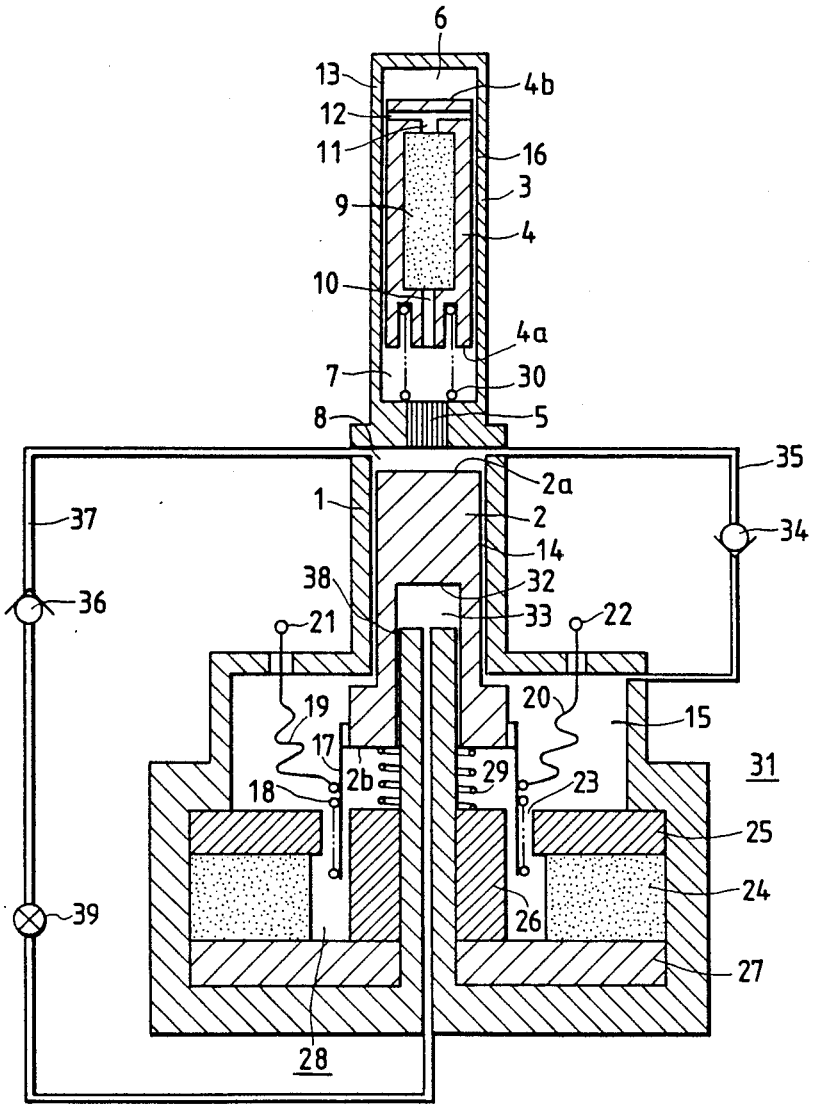
FIG. 3 is a cross sectional side view of a gas refrigerator having a gas compressor according to another embodiment of the present invention.

Further, as shown in FIG. 3, it is possible to provide flow resistance regulation means 39 in the second connecting circuit 37 so that flow resistance of the second connecting circuit 37 can be changed. In such case, since the average pressure Pb2 of the second buffer space 33 can be set to an arbitrary value within the following range by changing the flow resistance of the second connecting circuit 37 by means of the flow resistance regulation means $$Pb1<Pb2<Pmax \quad (8)$$

it is possible to change the neutral point of movement of the piston 2 even during its operation by controlling pressure value Pb2.

Figure 4A:
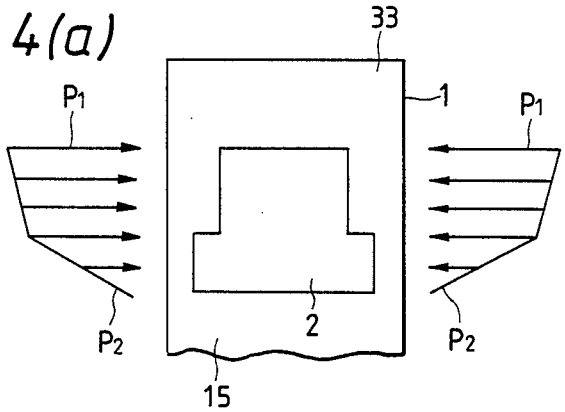
FIGS. 4*a* and 4*b* are drawings showing an operational principle of a surface contraction type hydrostatic gas bearing which is an example of a hydrostatic bearing used in a gas compressor according to another embodiment of the present invention.
Figure 4B:
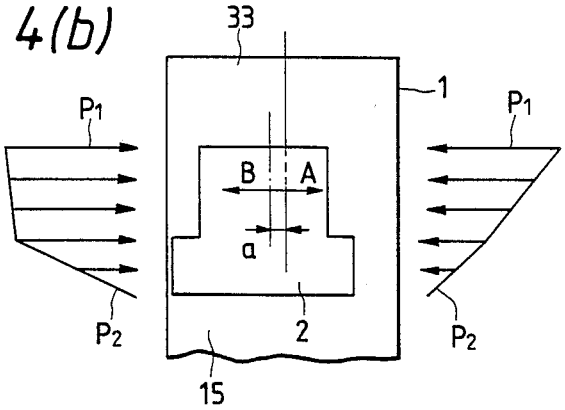

The pending U.S. patent application Ser. No. 207,408 discloses a non-contact reciprocation of a piston in a cylinder by means of a surface contraction type hydrostatic gas bearing and a connecting circuit including a check valve. FIGS. 4*a* and 4*b* show an operational principle of such surface contraction type hydrostatic gas bearing which is an example thereof usable in a gas compressor according to an embodiment of the present invention. As shown in FIG. 4*a*, when a center of the piston 2 coincides with a center of the cylinder 1, a distribution of piston side pressure acting on the side surface of the piston is symmetrical about the center of the piston. Further, as shown in FIG. 4*b*, when the piston 2 is eccentric to the cylinder 1, pressure on the side of the piston in which a gap is reduced by an eccentricity becomes higher than that on the other side, resulting in a reaction force A pushing the piston 2 in such a way that the centers of the piston 2 and cylinder 1 become coincident. This means that a side load B of the piston 2 can be supported while the piston 2 is floating with respect to the cylinder 1 and thus the piston 2 can reciprocate without any contact with the cylinder. In this manner, the force which acts such that the gap between the cylinder 1 and the piston 2 is kept constant is produced by the action of the hydrostatic gas bearing and thus the piston 2 always reciprocates in non-contact relation to the cylinder 1.

Figure 5:
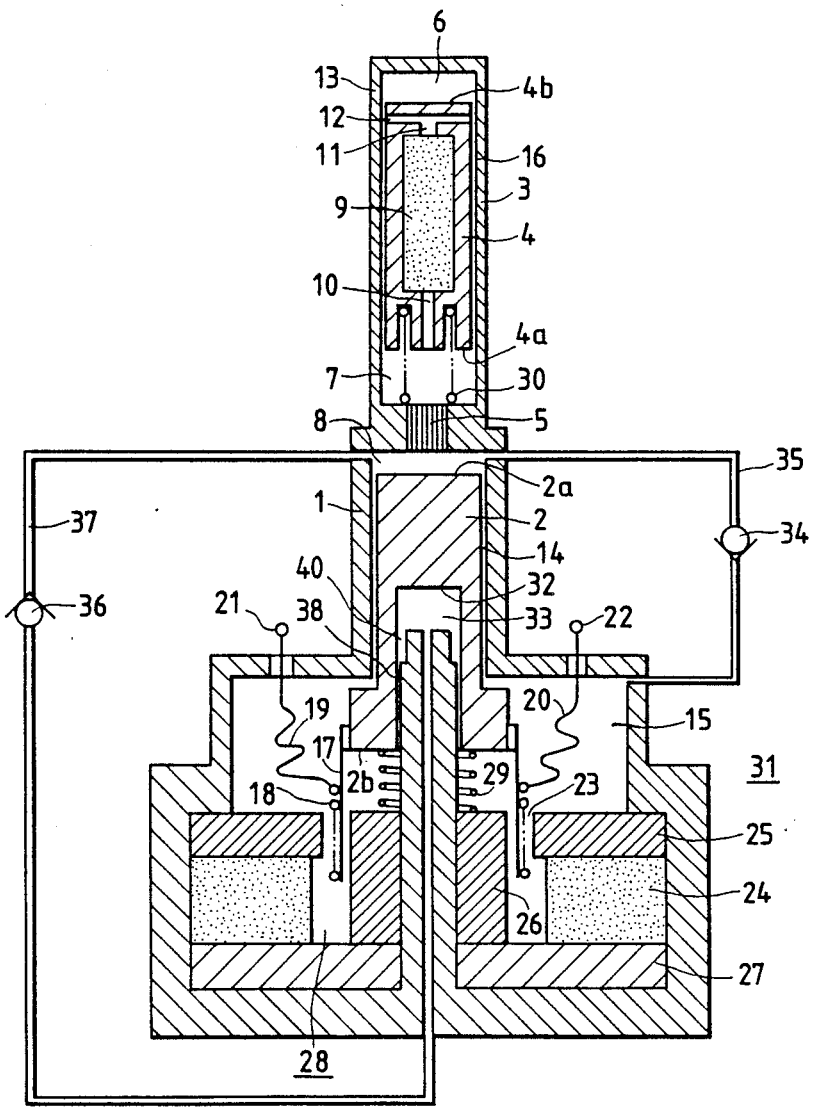
FIG. 5 is a cross sectional side view of a gas refrigerator having the hydrostatic gas bearing shown in FIG. 4.

FIG. 5 shows another embodiment in which a hydrostatic gas bearing 40 is provided on the clearance seal 38 between the piston 2 and the cylinder 1, which operates by means of a pressure difference (Pb2−Pb1) between, for example, the second buffer space 33 and the first buffer space 15. In this case, since the piston 2 reciprocates in the cylinder 1 in non-contact relation thereto, there is no wear of the piston 2 and the cylinder 1, resulting in elongated life of the refrigerator.

In the refrigerator having the construction shown in FIG. 5, by making the areas S2 and S3 of the second working surface 2*b* and the third working surface 32 substantially equal to each other, it is possible to obtain the refrigerator which has no wear of the piston 2 and the cylinder 1, is long life and has the same performance characteristics as that of the conventional refrigerator as is clear from the equation 6.

In this embodiment, the hydrostatic gas bearing is not limited to the stepped surface contraction type shown in the figure. It may be a hydrostatic gas bearing of a groove type or any hydrostatic gas bearing of other type such as orifice contraction, etc.

Figure 6:
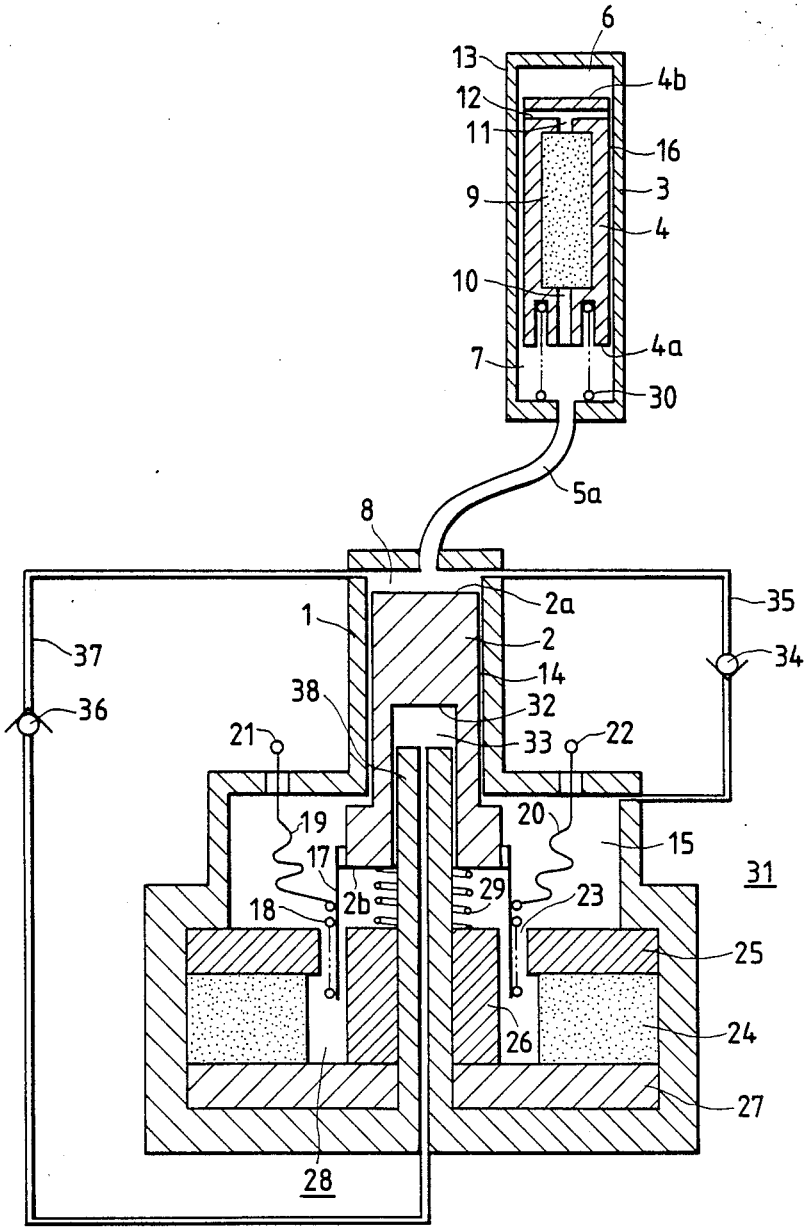
FIGS. 6 and 7 are cross sectional side views of gas refrigerators having gas compressors according to other embodiments of the present invention.

Although, in the respective embodiments described, refrigerators of integral type in which the cold finger 3 and the cylinder 1 are mechanically intimately coupled, it may be of a split type in which the cold finger 3 is connected through a connecting tube 5*a* to the cylinder 1 as shown by another embodiment shown in FIG. 6, with the same effects as those of the previous embodiments.

Figure 7:
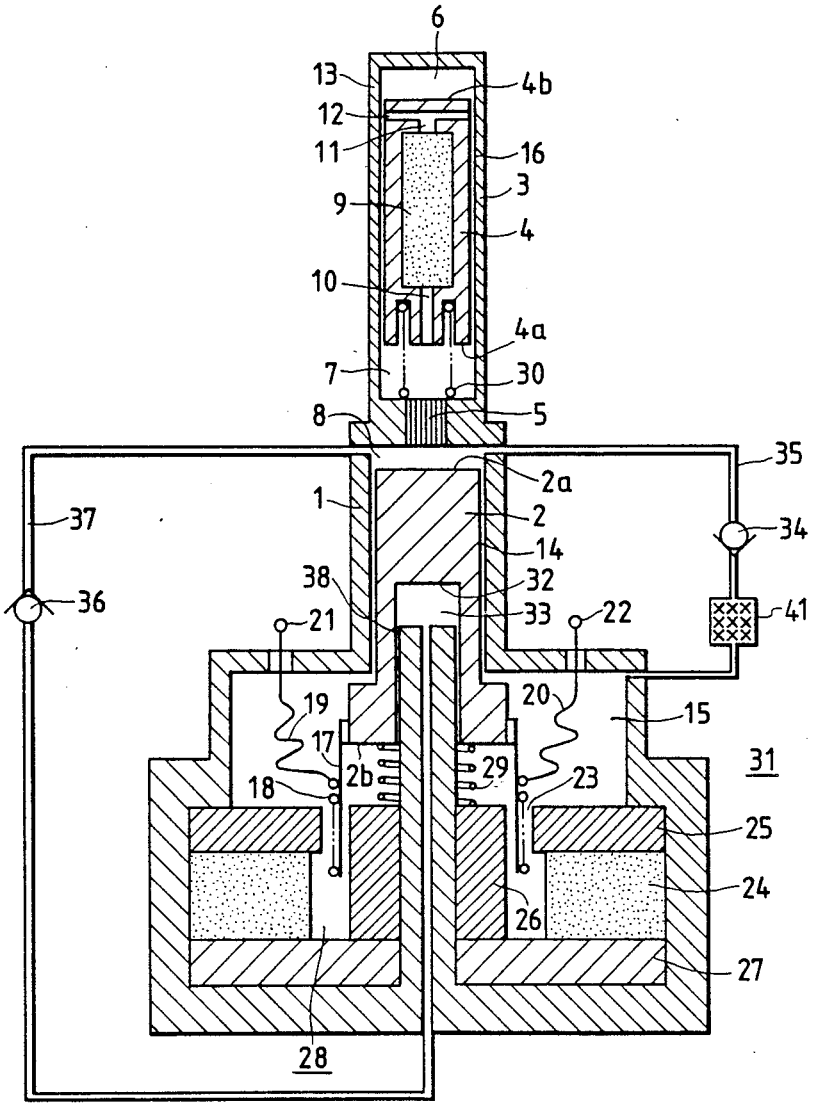

Further, as shown in FIG. 7, an adsorption chamber 41 may be provided for capturing or adsorbing particles produced by abrasion and contained in working gas or gases other than working gas in the first connecting circuit 35 or the second connecting circuit 37. In such case, since circulating working gas is always cleaned by the adsorption chamber 41, a refrigerator having a longer life is obtained.

Although, in the description hereinbefore, the gas compressor according to the present invention is described as being applied to the Stirling cycle gas refrigerator, it is clear from the foregoings that it can be used as a gas compressor of a thermodynamic machine based on other thermodynamic cycle such as Gifford-McMahon cycle or Rankine cycle, etc.

As described hereinbefore, the present invention comprises a compression space provided in a cylinder and having a volume varied with a positional shift of a first working surface provided on a piston when the latter reciprocates, pressure of working gas filled in the space being varied accordingly, two buffer spaces communicated with the compression space through gap sealing portions between the piston and the cylinder and having volumes varied with positional shifts of a second and a third working surfaces provided on the piston and acting in a reverse direction to that of the first working surface and two connecting circuits for connecting the buffer spaces and the compression space through check valves connected such that flow directions looked from the compression space are opposite, wherein forces acting on the piston working surfaces of the buffer spaces are set in such a way that, when a reciprocation stroke of the piston is to be lengthened, a neutral position of the piston reciprocation does not approaches on the side of the compression space and, when the reciprocation stroke is to be shortened, the neutral position does not go away. Therefore, the dead space of the compression space is minimized and a highly efficient operation can be realized in a wide output control range.

What is claimed is:

1. A gas compressor comprising a cylinder, a piston adapted to reciprocate in said cylinder, said piston having a first working surface, a compression space defined between said first working surface and a top surface of said cylinder and having a volume varied with a positional shift of said first working surface when said piston reciprocates to vary pressure of working gas filling in said compression space accordingly, a first buffer space provided below a second working surface of said piston and communicated through a clearance seal between said piston and said cylinder with said compression space, said piston being formed with a blind hole having a top surface acting as a third working surface, a second buffer space provided in said blind hole of said piston and communicated with said first buffer space through a clearance seal, said second buffer space having a volume varied with the positional shift of said third working surface in a reverse direction to that of said compression space, a first connecting circuit for connecting said first buffer space and said compression space and allowing working gas flow in one direction with respect to said compression space and a second connecting circuit for connecting said second buffer space and said compression space and allowing working gas flow in the opposite direction, whereby forces acting on said first, said second and said third working surfaces are set in such a way that, when a reciprocation stroke of said piston is to be lengthened, a shift of a neutral position of the piston reciprocation toward said compression space is prevented and, when the reciprocation stroke is to be shortened, shift of the neutral position away from said compression space is prevented.

2. The gas compressor as claimed in claim 1, wherein said first and said second connecting circuits include check valves, respectively.

3. The gas compressor as claimed in claim 1 or 2, further comprising flow resistance regulation means provided in said second connecting circuit for determining an average pressure in said second buffer space.

4. The gas compressor as claimed in claims 1 or 2 further comprising a hydrostatic gas bearing provided between said stud and said blind hole of said piston for supporting said piston in non-contact relation to said cylinder.

5. The gas compressor as claimed in claims 1 or 2 further comprising adsorbing means provided in said first connecting circuit for removing substances other than the working gas.

* * * * *